US006153981A

United States Patent [19]

Thomas et al.

[11] Patent Number: 6,153,981

[45] Date of Patent: Nov. 28, 2000

[54] STROBING LIGHT CONTROL ADAPTER

[75] Inventors: Edward J. Thomas, Streetsboro; Daniel A. Haas, Kent, both of Ohio

[73] Assignee: General Electric Company, Schenectady, N.Y.

[21] Appl. No.: 09/253,196

[22] Filed: Feb. 19, 1999

[51] Int. Cl.[7] ..... H05B 41/30

[52] U.S. Cl. ..... 315/241 S; 315/360; 315/200 A

[58] Field of Search ..... 315/291, 307, 315/224, 241 P, 241 S, 241 R, 200 A, 209 R, 360, 287, 308

[56] References Cited

U.S. PATENT DOCUMENTS

| | | | |
|---|---|---|---|
| 4,321,507 | 3/1982 | Bosnak | 315/200 A |
| 4,422,016 | 12/1983 | Kurple | 315/241 S |
| 5,105,127 | 4/1992 | Lavaud et al. | 315/307 |
| 5,453,668 | 9/1995 | Chow | 315/307 |
| 5,982,112 | 11/1999 | Pringle et al. | 315/200 A |

*Primary Examiner*—Don Wong
*Assistant Examiner*—Wilson Lee
*Attorney, Agent, or Firm*—Fay, Sharpe, Fagan, Minnich & McKee, LLP

[57] ABSTRACT

A strobing control adapter (10) includes first electrical connectors (52, 54), for connecting the adapter (10) to a power supply (12), and second electrical connectors (56, 58), for connecting the adapter (10) to a light source (14). A strobing circuit (50) is electrically connected to the first and second electrical connectors (52, 54, 56, 58). The strobing circuit (62) includes a first circuit (62) and a second circuit (64). The first circuit (62) generates a strobe signal delivered to the light source (14) via the second electrical connectors (56, 58). The second circuit (64) generates a modulation signal introduced into the first circuit (62) for causing the light source (14) to strobe aperiodically.

17 Claims, 6 Drawing Sheets

STROBING LIGHT CONTROL ADAPTER

BACKGROUND OF THE INVENTION

The present invention relates to electronic control circuits for strobe lights. It finds particular application in conjunction with controlling both a rate and a modulation of a strobe light and will be described with particular reference thereto. However, it is to be appreciated that the present invention is also amenable to other like applications.

Strobe light circuits are typically used with a variety of lights for creating special effects. Such circuits are often used with standard incandescent lamps, black lamps, outdoor flood lamps, and even fluorescent lamps. For example, strobe light circuits have been incorporated into decorative lighting displays used during holidays.

Conventional strobe light circuits are designed to cause a light to alternately turn on and off (i.e., strobe) at a predetermined frequency. Some circuits even permit the rate of the predetermined frequency to be modulated by adjusting a speed control. However, once the speed control is set in a conventional strobe light circuit, the frequency of the strobe is constant. In other words, if the speed control is set to fast, the strobe circuit causes the light to strobe quickly. Similarly, if the speed control is set to slow, the strobe circuit causes the light to strobe slowly. Therefore, although conventional strobe light circuits permits the rate at which the lamp strobes to be varied, the frequency of the strobing action is constant once the rate is set. In other words, conventional strobe light circuits only permit lamps to strobe periodically.

In some situations it is desirable to cause the strobing effect to have a first frequency during a first time period, a second frequency during a second time period, a third frequency during a third time period, etc. In this manner, the overall strobing effect is aperiodic. Conventional strobe light circuits do not make it possible to strobe a lamp aperiodically (i.e., at different rates during random time intervals).

The present invention provides a new and improved apparatus which overcomes the above-referenced problems and others.

SUMMARY OF THE INVENTION

An electrical circuit for creating a strobing effect in a lamp includes a strobing sub-circuit, for outputting a strobing effect to the lamp. The strobing sub-circuit is electrically connected to a power source. A modulation sub-circuit interjects a modulation signal into the strobing sub-circuit. The modulation sub-circuit is connected to the power source. The modulation signal causes the strobing effect to be aperiodic.

The modulation sub-circuit interjects a triangular shaped signal into the strobing sub-circuit.

The modulation sub-circuit interjects a triangular-shaped signal into the strobing sub-circuit and the modulating sub-circuit includes a first variable resistor. The variable resistor adjusts an amplitude of the triangular-shaped signal interjected into the strobing sub-circuit.

A switching device, electrically connected to an output of the strobing sub-circuit, controls power produced at the output of the strobing sub-circuit and delivered to the lamp.

The power supplied by the power source is an alternating current and the strobing sub-circuit includes a power circuit for transforming the alternating current into a direct current. The direct current powers the strobing sub-circuit and the modulation sub-circuit.

The strobing sub-circuit includes at least one timing device.

The timing device includes at least one integrated circuit device.

A second variable resistor controls a frequency of the strobing effect.

A switching device includes an on-mode when current flows through the switching device and an off-mode when the current does not flow through the switching device. At least one resistor, electrically connected to the switching device, allows current to flow to the lamp when the switching device is in the off-mode.

One advantage of the present invention is that a lamp may be strobed aperiodically.

Another advantage of the present invention is that in addition to controlling the rate of the strobing effect, a user may also control a period of the strobing effect.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
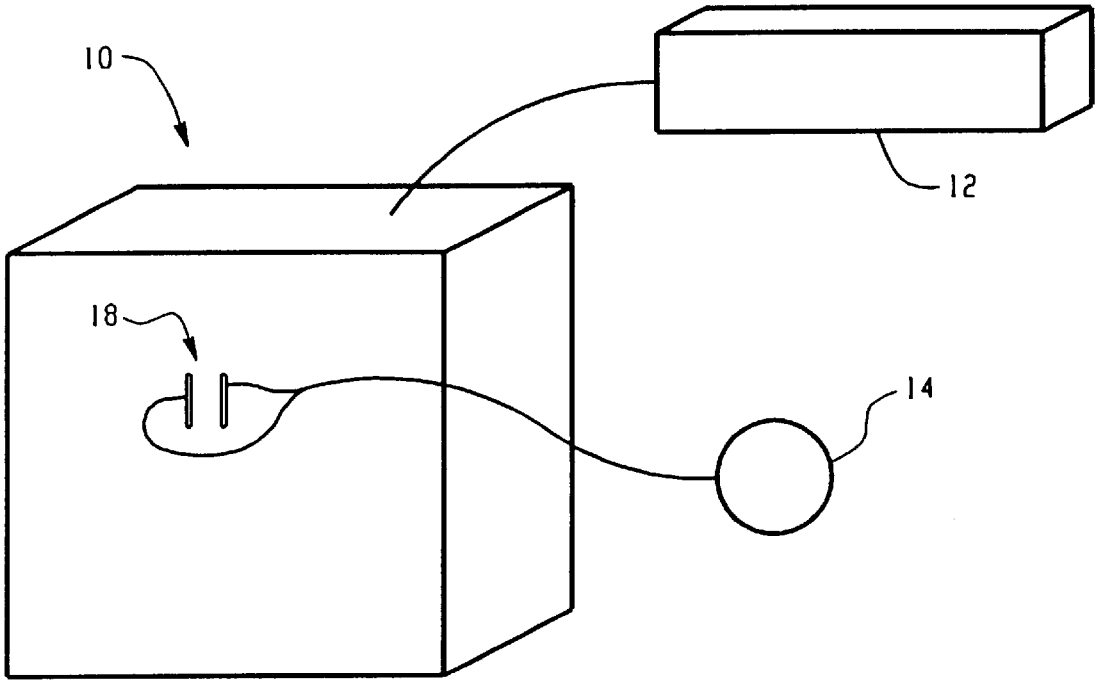
FIG. 1 illustrates a perspective view of the strobing light control adapter according to the present invention.

FIG. 1 illustrates a strobing light control adapter 10, which is electrically connected to an electrical power source 12. Preferably the electrical source 12 is a 120 Volt, 60 Hertz alternating current ("AC") power source. However, it is to be understood that other types of power sources are also contemplated. A light source 14 is electrically connected to the strobing light control adapter 10.

Figure 2:
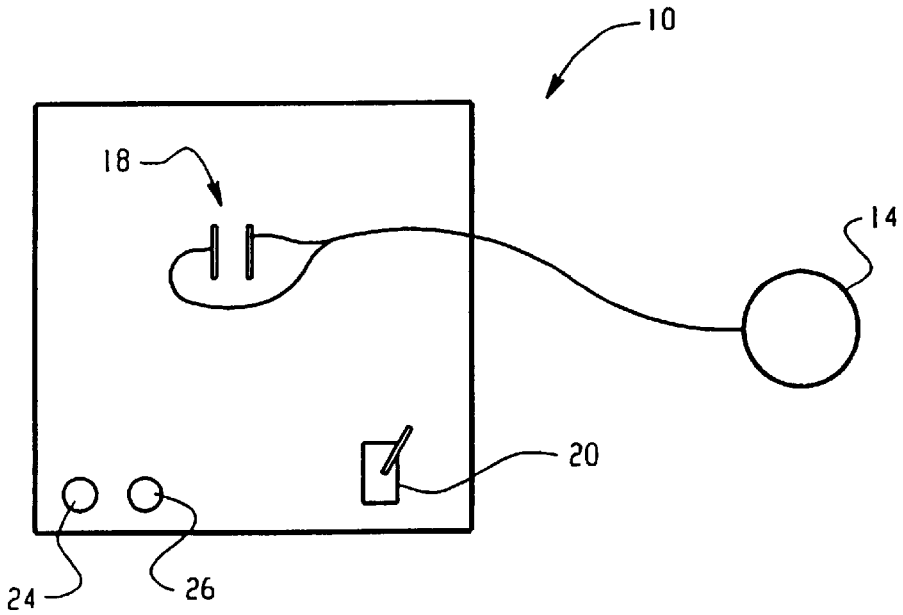
FIG. 2 illustrates a front view of the strobing light control adapter shown in FIG. 1.

FIG. 2 illustrates a front view of the light control adapter 10. The adapter 10 includes a male plug (not shown), which connects to the electrical power source. A female plug 18 formed in the control adapter 10 is designed for accepting a male plug from the light source 14. A power switch 20 controls power flow between the male and female plugs of the adapter 10. A speed control 24 is used for modulating the frequency at which the light source 14 strobes during various periods. A period control 26 is used for modulating the length of the periods. The speed control 24 and the period control 26 permit a user to adjust the strobing effect of the lamp 14.

Figure 3:
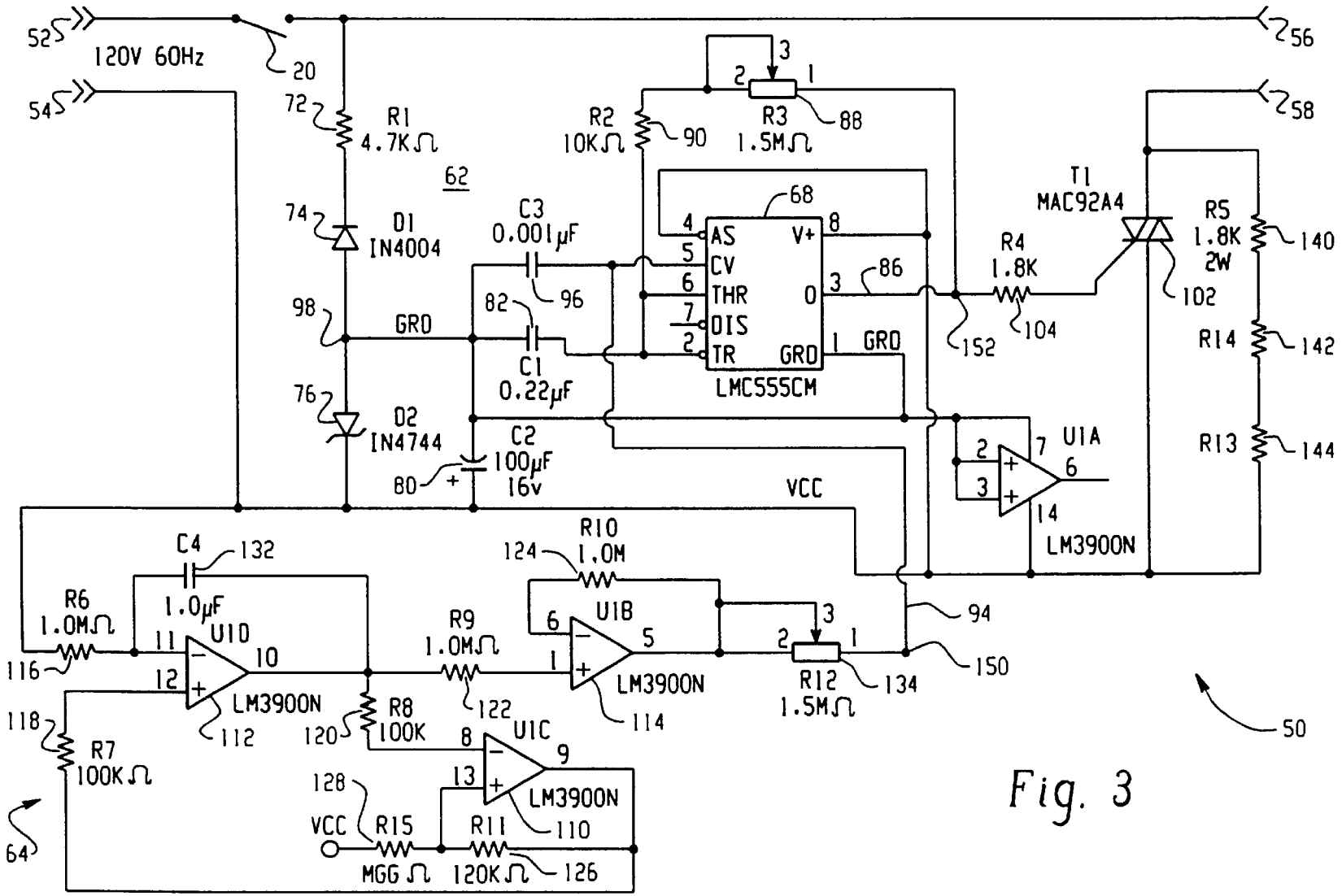
FIG. 3 illustrates an electrical strobing circuit included within the light control adapter shown in FIGS. 1 and 2.

FIG. 3 illustrates an electrical strobing circuit 50 that is included within the light control adapter. With reference to FIGS. 2 and 3, first connectors 52, 54 are electrically connected to respective prongs of the male plug extending from the adapter 10. Second connectors 56, 58 are electrically accessible within the respective openings of the female plug 18. The second connectors 56, 58 are electrically connected to the lamp source 14.

The circuit 50 illustrated in FIG. 3 includes a main strobing sub-circuit 62 and a modulation sub-circuit 64. The main strobing sub-circuit 62 provides a standard strobing action to the light source 14, which is electrically connected to the second connectors 56, 58. The speed control 24 adjusts the frequency at which the strobing effect occurs. The modulation sub-circuit 64 causes the strobing effect to occur aperiodically.

A timer chip 68 is used for creating the strobing effect. Preferably, the timer chip 68 is a LMC555 CMOS Timer. However, it is to be understood that other timer chips are also contemplated.

A power resistor 72, first and second power diodes 74, 76, respectively, and a power capacitor 80 form a power circuit within the main strobing circuit 62. The power circuit transforms the AC power, received from the power source, into a relatively low direct-current ("DC") voltage, which powers the main strobing circuit 62. The second power diode 76, which is preferably a zener diode, regulates the DC power to about 15 Volts. The first power diode 74 serves as a half-wave rectifier; the power resistor 72 serves as a line-dropping resistor; and the power capacitor 80 serves as a bulk storage for the DC supply.

The timer chip 68 substantially acts as a window comparator and an output latch. The window comparator function monitors the voltage on a timing capacitor 82 and compares a voltage on the timing capacitor 82 to an internal voltage divider string. The internal voltage divider string has nominal setpoints at ⅓ and ⅔ of the supply power. In the preferred embodiment, the supply power is about 15 Volts. If the supply power (i.e., Vcc) is 15 Volts, the internal divider string causes the window comparator to have setpoints of 5 and 10 Volts. During a typical operation, the voltage on the timing capacitor 82 varies between ⅓ and ⅔ of 15 Volts. For the time during which the timing capacitor 82 is charging, the output is driven to the high state. Then, while the timing capacitor 82 is discharging, the output is driven to the low state, thereby causing an astable (i.e., free running) operation. A 50% duty cycle is established by using the output signal 86 from the timer chip 68 as a voltage source for a resistor-capacitor timing circuit including a variable timing resistor 88, a timing resistor 90, and the timing capacitor 82. The basic period frequency of the timing chip 68 is then varied by adjusting the value of the variable timing resistor 88.

Once the timing chip 68 is operating as described above, the frequency of operation is relatively fixed, or periodic. The modulation sub-circuit 64 acts on the internal divider string, thereby affecting the established ⅓ to ⅔ Vcc trip points. A modulation signal 94, produced by the modulation sub-circuit 64, is introduced into the timer chip 68. A capacitor 96, which is connected to a ground 98, buffers the modulation signal 94.

The modulation signal 94 affects the internal divider string of the timer chip 68. More specifically, any voltage introduced into the timer chip 68 results in new trip points being established, as a function of the summation of the added voltage and the existing voltage on the divider. For example, if the imposed voltage is lower than ⅔ Vcc, the trip points move down, thereby causing the frequency of the oscillation to increase. Similarly, if the imposed voltage is higher than ⅔ Vcc, the trip points move up, thereby causing the frequency of the oscillation to decrease.

Introducing the modulation signal into the timer chip 68 causes the operating frequency of the timer chip 68 to increase/decrease, thereby causing the frequency of the output to become aperiodic. Such aperiodic operation, which adds apparent randomness to an output signal of the timer chip 68, is technically termed pulse position modulation. The output signal 86 of the timer chip 68 is connected to a triac 102, which acts as a power switch. A resistor 104 limits the current to the triac 102. The triac 102 ultimately controls the power that is supplied to the lighting device 14. Therefore, introducing the modulation signal 94 into the timer chip 68 ultimately causes the strobing effect of the lamp 14 to become random.

In the preferred embodiment, the modulation signal is generated using three op-amps 110, 112, 114 on an LM3900N chip, seven (7) resistors 116, 118, 120, 122, 124, 126, 128, a capacitor 132, and a variable resistor 134 as illustrated in FIG. 3. Preferably, the components are configured to produce a triangle wave modulation signal operating at a low frequency (e.g., about 1 Hertz). However, it is to be understood that other components, other integrated circuit chips and/or other modulation signal waveforms are also contemplated.

The input power source is fed into the negative input of the op-amp 112, via the resistor 116. The output of the op-amp 112 is fed back into the negative input via the capacitor 132. Also, the output of the op-amp 112 is fed into the negative input of the op-amp 110, via the resistor 120, and the positive input of the of the op-amp 114, via the resistor 122. The output of the op-amp 110, which is a square-wave, is fed back into the positive input of the op-amp 110, via the resistor 126. Power is also supplied to the positive input of the op-amp 110 via the resistor 128. The output of the op-amp 110 is also fed into the positive input of the op-amp 112 via the resistor 118. The output of the op-amp 114, which is a triangle wave, is fed back into the negative input of the op-amp 114 via the resistor 124. The triangular output of the op-amp 114 is also fed into the variable resistor 134, which adjusts the amplitude of the wave. The output of the variable resistor 134 is fed into the timer chip 68.

The output of the op-amp 112 is buffered before it enters the op-amps 110, 114. The buffer creates a unity gain and serves to isolate the triangle generator from internal voltages of the timer chip 68. The square-wave output from the op-amp 110 is actually a Schmitt trigger, or an inverting comparator with hysteresis. The switching points are determined by resistor selection to establish current matching into the positive and negative inputs of 110. The output of the op-amp 110 is tied to the input of the op-amp 112 for integrating the square-wave to create a triangle-wave. The symmetry of the triangle wave is adjusted by the resistor 120.

The capacitor 132 serves as an integration capacitor. The resistors 116, 128 serve as biasing resistors. The resistor 126 provides local feedback for the square-wave generator 110 while the resistor 118 provides an input impedance to isolate the square-wave output from the integrator input. The resistor 122 is a coupling resistor from the triangle output to the unity gain buffer op-amp 114.

The low-frequency triangle waveform is introduced into the timer chip 68 via the potentiometer 134. The potentiometer 134 allows an operator to select a level of modulation for a desired strobing effect. Importantly, both the speed and the modulation of the strobe rate are controllable, via the speed control 24 and the period control 26, to achieve desired lighting effects. The speed control 24 adjusts the variable timing resistor 88. The period control 26 adjusts the potentiometer 134.

Optionally, keep-alive resistors 140, 142, 144 are used to allow some current to flow to the lamp 14 while the triac 102 is turned off. In the case of fluorescent style lighting, the keep-alive resistors 140, 142, 144 provide a basic background level of current flow to keep the fluorescent tube from completely extinguishing, and requiring a restart each time the triac turns-off. In the case of incandescent lighting the keep-alive resistors 140, 142, 144 are not needed, but still provides a minimal current flow as described.

FIGS. 4–7 each illustrate upper and lower waveforms obtained at points 150, 152, respectively, indicated in FIG. 3. The upper waveform in each of FIGS. 4–7 indicates the modulation of the strobing effect. The lower waveform in each of FIGS. 4–7 indicates the waveform output from the timer chip 68 (see FIG. 3), which, consequently, is input to the triac 102 (see FIG. 3). The frequency of the lower waveform in each of FIGS. 4–7 correlates to the frequency at which the lamp 14 will strobe.

Figure 4:
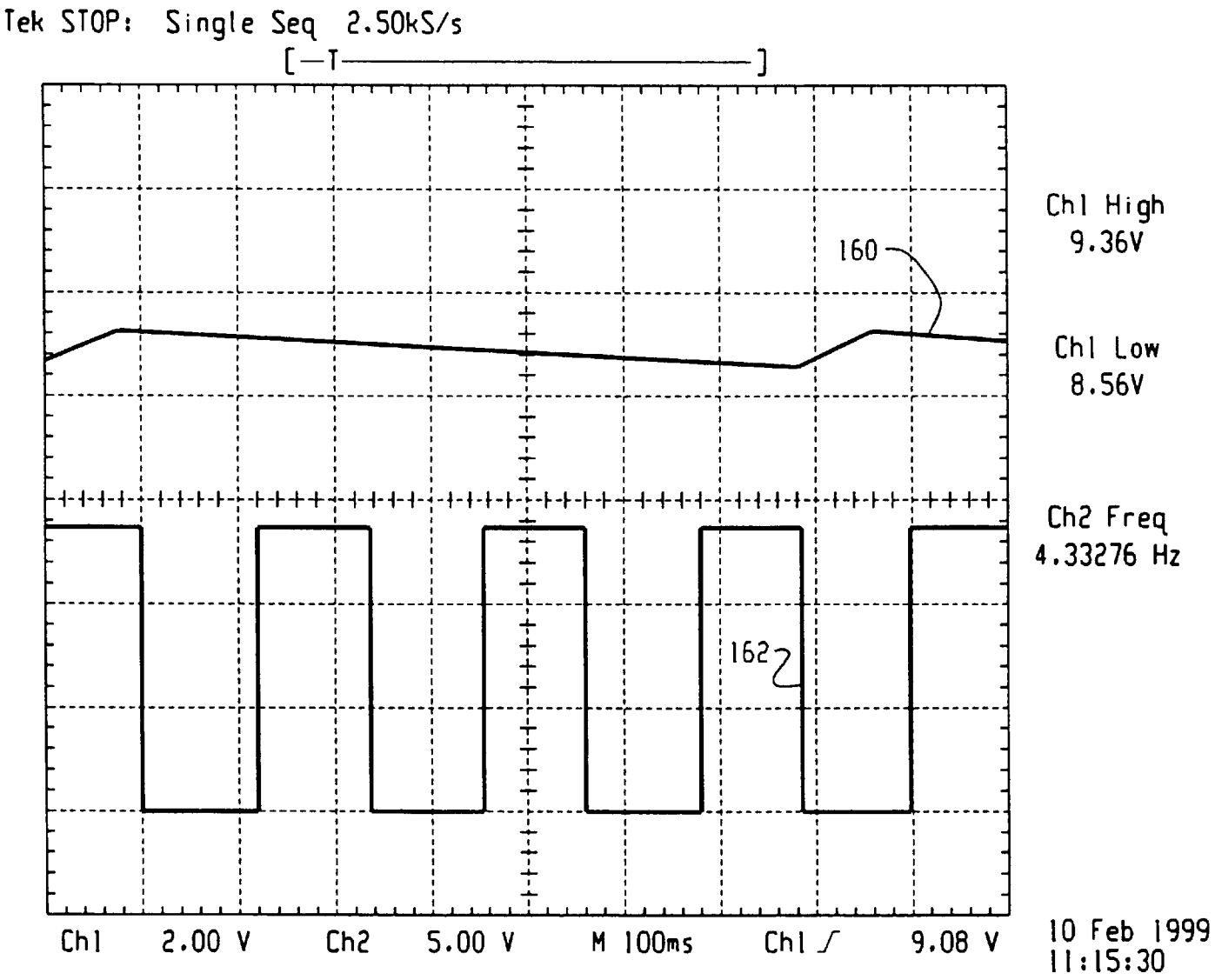
FIG. 4 illustrates waveforms when both the rate and the modulation controls are set to a minimum.

FIG. 4 illustrates upper and lower waveforms 160, 162, respectively, obtained when both the rate and the modulation controls 24, 26, respectively, are set to a minimum. The modulation waveform 160 varies from a low of 8.56 Volts DC to a high of 9.36 Volts DC. The frequency of the waveform 162 corresponding to the strobe output is 4.33 Hertz. Note that the lower waveform 162 is substantially periodic.

Figure 5:
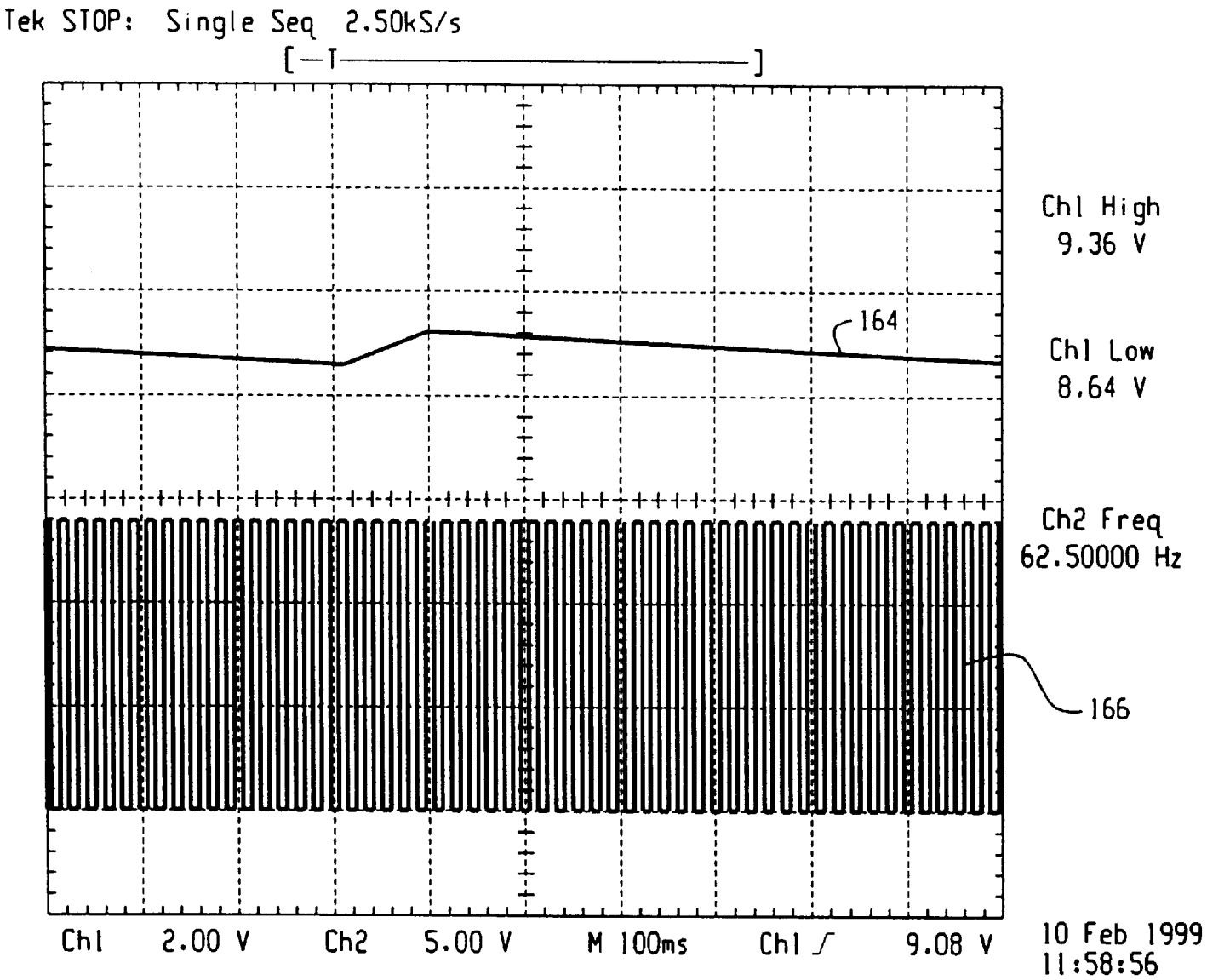
FIG. 5 illustrates waveforms when the rate is set to a maximum and the modulation control is set to a minimum.

FIG. 5 illustrates upper and lower waveforms 164, 166, respectively, obtained when the rate control 24 is set to a maximum and the modulation control 26 is set to a minimum. The modulation waveform 164 varies from a low of 8.64 Volts DC to a high of 9.36 Volts DC. The frequency of the waveform 166 corresponding to the strobe output is 62.40 Hertz. As in FIG. 4, the lower waveform 166 is substantially periodic.

Figure 6:
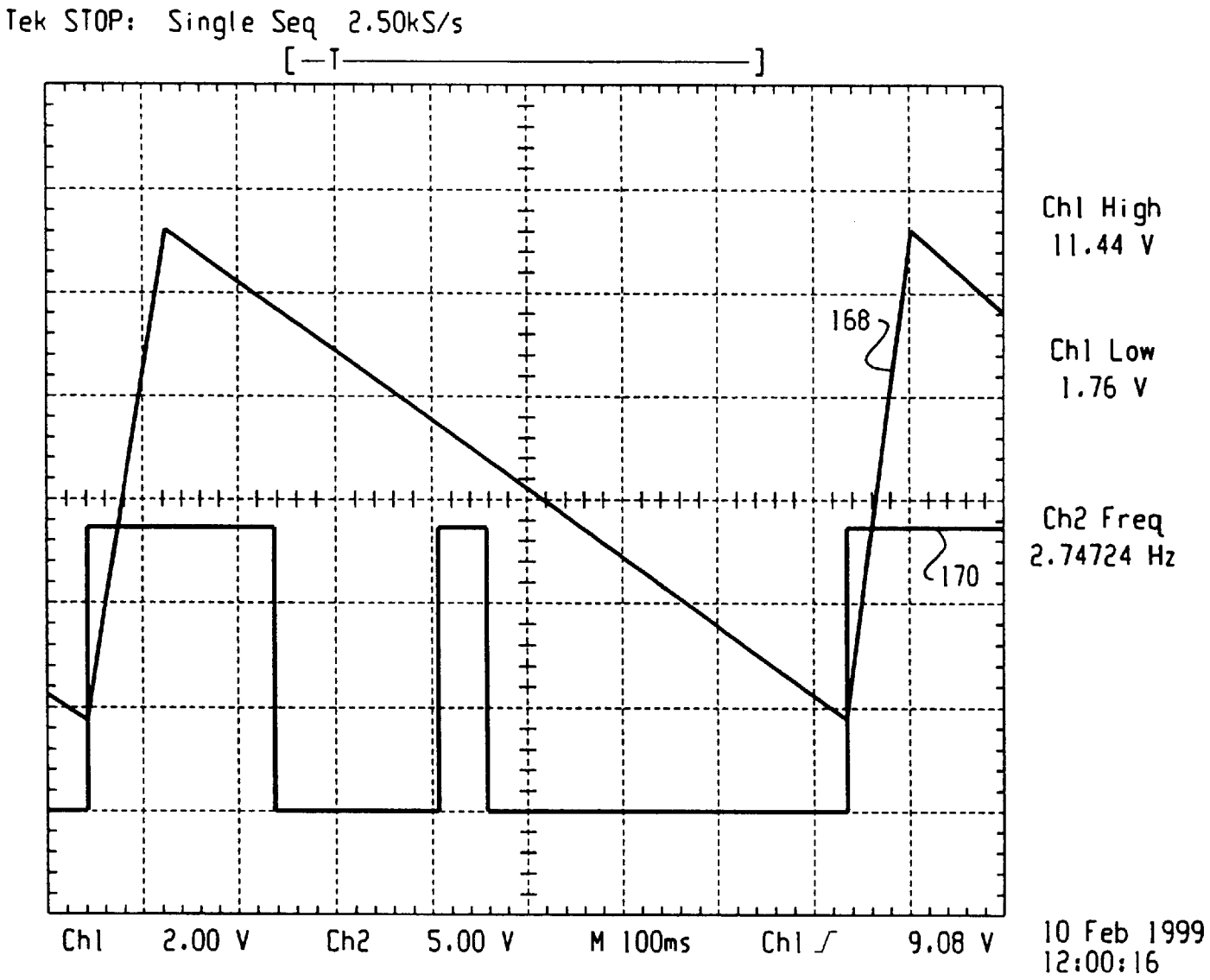
FIG. 6 illustrates waveforms when the rate is set to the minimum and the modulation control is set to a maximum.

FIG. 6 illustrates upper and lower waveforms 168, 170, respectively, obtained when the rate control 24 is set to a minimum and the modulation control 26 is set to a maximum. The modulation waveform 168 varies from a low of 1.76 Volts DC to a high of 11.44 Volts DC. The frequency of the waveform 170 corresponding to the strobe output is 2.75 Hertz. Unlike FIG. 5, the lower waveform 170 is aperiodic.

Figure 7:
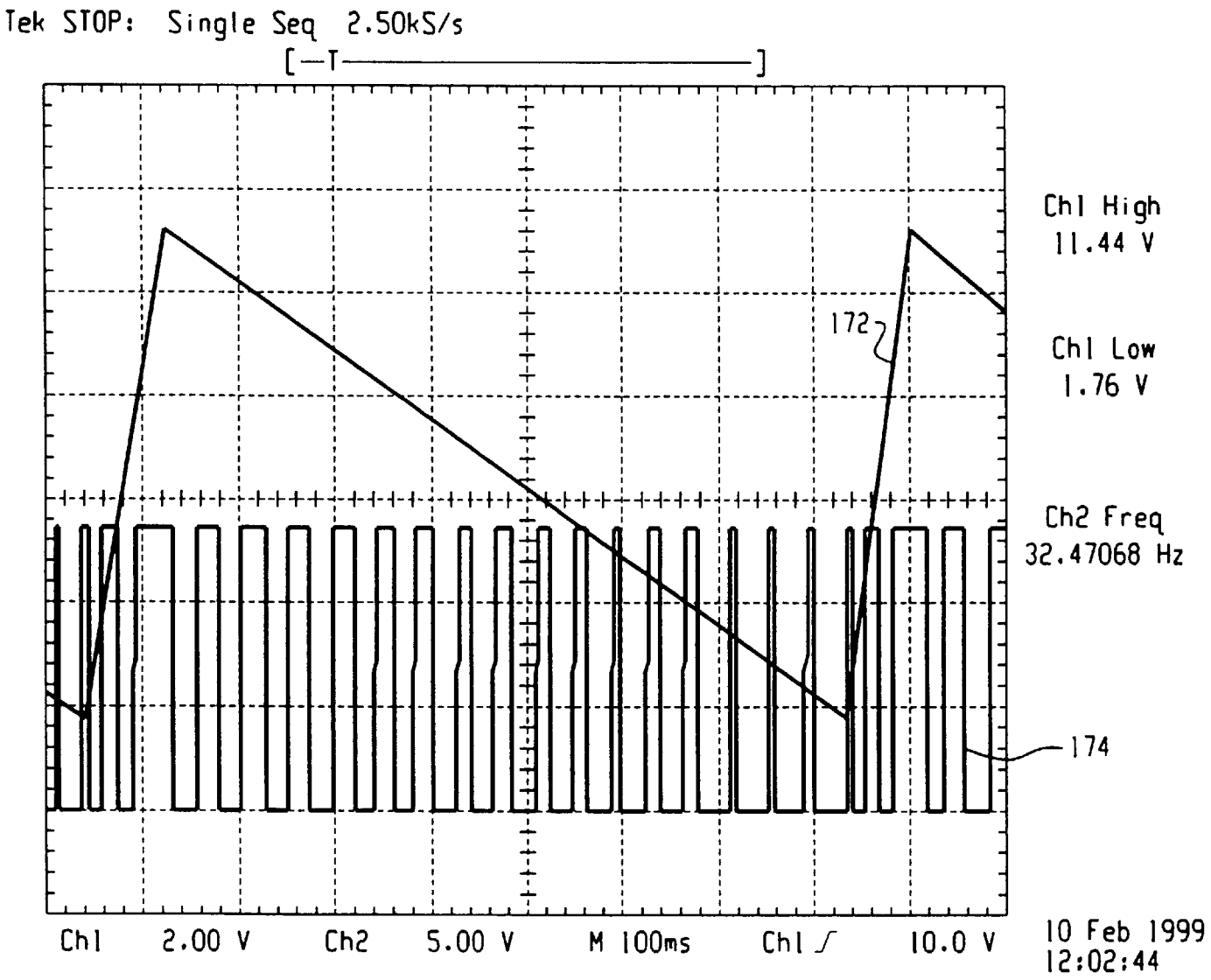
FIG. 7 illustrates waveforms when the rate control is set to approximately 70% of a maximum and the modulation control is set to a maximum.

FIG. 7 illustrates upper and lower waveforms 172, 174, respectively, obtained when the rate control 24 is set to about 70% of a maximum and the modulation control 26 is set to a maximum. The modulation waveform 172 varies from a low of 1.76 Volts DC to a high of 11.44 Volts DC. The frequency of the waveform 174 corresponding to the strobe output is 32.47 Hertz. As in FIG. 6, the lower waveform 174 is aperiodic.

It can be seen from the lower waveforms 162, 166, 170, 174 in FIGS. 4–7, respectively, that adjustment of the modulation control 26 affects whether the waveform signal introduced into the triac 102 is periodic or aperiodic. More specifically, when the modulation control 26 is set to the minimum, the waveform signal introduced into the triac 102 is substantially periodic. When the modulation control 26 is set to a position other than the minimum, the waveform signal introduced into the triac 102 becomes substantially aperiodic. As stated earlier, the strobing effect of the lamp 14 is a function of the waveform signal introduced into the triac 102.

While the present invention has been described in terms of manually modulating the speed and period of the strobing effect, it is also contemplated that the strobing effect be modulated via voice or sound.

The invention has been described with reference to several embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. An electrical circuit for creating a strobing effect in a lamp, comprising:

a strobing sub-circuit, for outputting a strobing effect to the lamp, electrically connected to a power source;

a modulation sub-circuit, for interjecting a pulse position modulation signal into the strobing sub-circuit, connected to the power source, the pulse position modulation signal causing a frequency of the strobing effect to be aperiodic.

2. The electrical circuit for creating a strobing effect in a lamp as set forth in claim 1, wherein the modulation sub-circuit interjects a triangular shaped signal into the strobing sub-circuit.

3. The electrical circuit for creating a strobing effect in a lamp as set forth in claim 1, wherein the modulation sub-circuit interjects a triangular-shaped signal into the strobing sub-circuit, the modulating sub-circuit including:

a first variable resistor for adjusting an amplitude of the triangular-shaped signal interjected into the strobing sub-circuit.

4. The electrical circuit for creating a strobing effect in a lamp as set forth in claim 3, further including:

a switching device, electrically connected to an output of the strobing sub-circuit, for controlling power produced at the output of the strobing sub-circuit and delivered to the lamp.

5. The electrical circuit for creating a strobing effect in a lamp as set forth in claim 4, wherein the power supplied by the power source is an alternating current, the strobing sub-circuit including:

a power circuit for transforming the alternating current into a direct current, the direct current powering the strobing sub-circuit and the modulation sub-circuit.

6. The electrical circuit for creating a strobing effect in a lamp as set forth in claim 4, wherein the strobing sub-circuit includes at least one timing device.

7. The electrical circuit for creating a strobing effect in a lamp as set forth in claim 6, wherein the timing device includes at least one integrated circuit device.

8. The electrical circuit for creating a strobing effect in a lamp as set forth in claim 4, further including:

a second variable resistor for controlling a frequency of the strobing effect.

9. The electrical circuit for creating a strobing effect in a lamp as set forth in claim 4, wherein the switching device includes an on-mode when current flows through the switching device and an off-mode when the current does not flow through the switching device, further including:

at least one resistor, electrically connected to the switching device, for flowing current to the lamp when the switching device is in the off-mode.

10. A strobing control adapter, comprising:

a first electrical connector for connecting the adapter to a power supply;

a second electrical connector for connecting the adapter to a light source;

a strobing circuit, electrically connected to the first and second electrical connectors, including:

a first circuit for generating a strobe signal delivered to the light source via the second electrical connector; and a second circuit for generating a pulse position modulation signal introduced into the first circuit for causing the light source to strobe at an aperiodic frequency.

11. The strobing control adapter as set forth in claim 10, further including:

a first control for modulating a rate of the strobing effect; and a second control for modulating a period of the strobing effect by adjusting the pulse position modulation signal.

12. The strobing control adapter as set forth in claim 10, wherein the first circuit includes at least one timing device, the pulse position modulation signal disrupting internal voltage settings of the at least one timing device for causing the frequency of the strobe signal to become aperiodic.

13. The strobing control adapter as set forth in claim 10, further including:

a switching device, electrically connected to the first circuit and the second electrical connector, for controlling the strobe signal delivered to the lamp.

14. The strobing control adapter as set forth in claim 10, wherein the pulse position modulation signal includes a substantially triangular shape.

15. The strobing control adapter as set forth in claim 14, wherein the second circuit includes at least one op-amp for generating the pulse position modulation signal.

16. The strobing control adapter as set forth in claim 15, wherein:

a first of the op-amps produces an square-shaped output; and the square-shaped output is received as an input to a second of the op-amps, the second op-amp producing a triangle-shaped output.

17. The strobing control adapter as set forth in claim 13, wherein the switching device includes an on-mode when current flows through the switching device and an off-mode when the current does not flow through the switching device, further including:

resistors for allowing current to flow to the light source while the switching device is in the off-mode.

* * * * *